US010476165B2

(12) United States Patent
Tseng et al.

(10) Patent No.: US 10,476,165 B2
(45) Date of Patent: Nov. 12, 2019

(54) ARTIFICIAL MAGNETIC CONDUCTOR AND ELECTRONIC DEVICE INCLUDING THE SAME

(71) Applicant: ASUSTeK COMPUTER INC., Taipei (TW)

(72) Inventors: Bin-Chyi Tseng, Taipei (TW); Tsung-Chieh Yen, Taipei (TW); Sheng-Chao Hong, Taipei (TW); Chin-Chia Chang, Taipei (TW); Hsien-Hsun Li, Taipei (TW)

(73) Assignee: ASUSTeK COMPUTER INC., Taipei (TW)

( * ) Notice: Subject to any disclaimer, the term of this patent is extended or adjusted under 35 U.S.C. 154(b) by 217 days.

(21) Appl. No.: 15/169,720

(22) Filed: May 31, 2016

(65) Prior Publication Data

US 2016/0351999 A1 Dec. 1, 2016

(30) Foreign Application Priority Data

Jun. 1, 2015 (TW) ..... 104117650 A

(51) Int. Cl.
*H01Q 15/00* (2006.01)
*H01Q 1/38* (2006.01)

(52) U.S. Cl.
CPC ..... *H01Q 15/0086* (2013.01); *H01Q 1/38* (2013.01)

(58) Field of Classification Search
CPC ..... H01Q 15/0006; H01Q 15/0013; H01Q 15/002; H01Q 15/0026; H01Q 15/006; H01Q 15/0066; H01Q 15/0086; H01Q 9/0407; H01Q 9/0414; H01Q 9/0464; H01Q 1/24; H01Q 1/241; H01Q 1/242; H01Q 1/243; H01Q 1/245; H01Q 1/38; H01Q 1/52; H01Q 1/521; H01Q 1/525; H01Q 15/00; H01Q 15/0033; H01Q 15/004; H01Q 15/0046; H01Q 15/0053; H01Q 15/0073; H01Q 15/008; H01Q 1/48

See application file for complete search history.

(56) References Cited

U.S. PATENT DOCUMENTS 6,906,674 B2 * 6/2005 McKinzie, III ..... H01Q 1/52 343/700 MS
7,002,518 B2 2/2006 Lin et al.
8,102,296 B2 1/2012 Tarng et al.
(Continued)

FOREIGN PATENT DOCUMENTS

CA 2775410 A1 * 10/2012 ..... H01Q 1/243
CN 103367881 10/2013
(Continued)

*Primary Examiner* — Daniel Munoz
*Assistant Examiner* — Patrick R Holecek
(74) *Attorney, Agent, or Firm* — JCIPRNET

(57) ABSTRACT

An artificial magnetic conductor comprising a base board, a first conducting element, a second conducting element and a first lumped element is provided. The first conducting element is disposed at a first side of the base board. The first conducting element includes an opening. The second conducting element is disposed at a second side of the base board. The first lumped element is disposed on the corresponding first conducting element. An electronic device including the artificial magnetic conductor is also provided.

10 Claims, 6 Drawing Sheets

(56) References Cited

U.S. PATENT DOCUMENTS

| | | | | |
|---|---|---|---|---|
| 8,587,469 | B2 * | 11/2013 | Bruno | G01S 7/36 342/16 |
| 9,570,814 | B2 * | 2/2017 | Ando | H01Q 9/30 |
| 2005/0057420 | A1 | 3/2005 | Lin et al. | |
| 2009/0153412 | A1 * | 6/2009 | Chiang | H01Q 1/52 343/702 |
| 2011/0122018 | A1 | 5/2011 | Tarng et al. | |
| 2011/0210903 | A1 | 9/2011 | Sarabandi et al. | |
| 2013/0252561 | A1 | 9/2013 | Alexopoulos et al. | |
| 2013/0285858 | A1 | 10/2013 | Grange et al. | |
| 2013/0321220 | A1 * | 12/2013 | Toujo | H01Q 13/08 343/702 |

FOREIGN PATENT DOCUMENTS

| | | |
|---|---|---|
| TW | I252607 | 4/2006 |
| TW | I425711 | 2/2014 |

* cited by examiner

ARTIFICIAL MAGNETIC CONDUCTOR AND ELECTRONIC DEVICE INCLUDING THE SAME

CROSS-REFERENCE TO RELATED APPLICATION

This application claims the priority benefit of Taiwan application serial No. 104117650, filed on Jun. 1, 2015. The entirety of the above-mentioned patent application is hereby incorporated by references herein and made a part of specification.

BACKGROUND OF THE INVENTION

Field of the Invention

The invention relates to an artificial magnetic conductor and an electronic device including the artificial magnetic conductor.

Description of the Related Art

With a rapid development of the wireless communication technology, various mobile communication devices, such as a smart phone, a tablet computer and a notebook computer, are launched. Manufacturers not only devote to promoting operating functions of the mobile communication devices, but also emphasize on product appearance to attract consumers.

Most current mobile communication devices have metallic appearances (such as a metal back cover or a metal frame). However, an antenna radiation characteristic is easily affected by metal. For example, the metal back cover shields the antenna to affect the communication capability of the antenna. Therefore, when a metal back over is configured to a mobile communication device, the communication quality of the mobile communication device is easily affected.

Generally, when a smart phone or a tablet computer uses a metal back cover, a built-in antenna and the metal back cover should be spaced apart from each other with a distance (for example, greater than 5 millimeter) to ensure the radiation efficiency of the antenna. If the distance is insufficient, radiation of a reverse current generated at the metal surface would neutralize the far-field radiation of the antenna.

Consequently, the radiation efficiency of the antenna is poor. However, if the distance between the antenna and the metal back cover is sufficient, the mobile communication device becomes thick.

BRIEF SUMMARY OF THE INVENTION

According to one aspect of the disclosure, an artificial magnetic conductor comprises: a base board; a first conducting element disposed at a first side of the base board and including an opening; a second conducting element disposed at a second side of the base board; and a first lumped element disposed on the corresponding first conducting element.

According to another aspect of the disclosure, an electronic device, comprising a front surface and a back surface opposite to each other, the electronic device comprises: a back cover disposed at the back surface; an antenna disposed at the front surface; and at least one artificial magnetic conductor located between the back cover and the antenna, wherein the artificial magnetic conductor includes: a base board; a first conducting element disposed at a first side of the base board and including at least one opening; a second conducting element disposed at a second side of the base board; and a first lumped element disposed on the corresponding first conducting element.

In sum, in embodiments, with the configuration of the first conducting element, the current is generated the same phase as the current in the antenna, which results good radiation efficiency. Furthermore, since the artificial magnetic conductor is directly connected to the electronic device without any interconnecting component, the thickness of the electronic device is reduced. Also, with the configuration of the first lumped element, the volume of the electronic device is reduced.

BRIEF DESCRIPTION OF THE DRAWINGS

These and other features, aspects and advantages of the invention will become better understood with regard to the following embodiments and accompanying drawings.

DETAILED DESCRIPTION OF THE EMBODIMENTS

Figure 1:
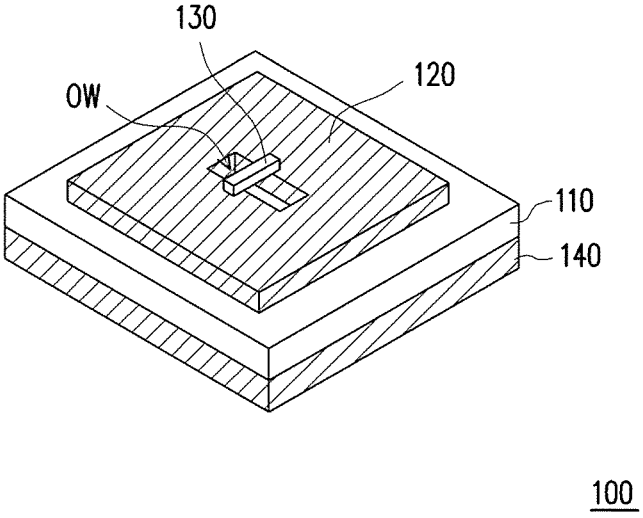
FIG. 1 is a schematic diagram showing an artificial magnetic conductor in an embodiment.

FIG. 1 is a schematic diagram showing an artificial magnetic conductor in an embodiment. Referring to FIG. 1, in the embodiment, an artificial magnetic conductor 100 is adapted to be assembled to an electronic devices 200*a*, 200*b*, 200*c* or 200*d* (as shown in FIG. 2A to FIG. 2D). The artificial magnetic conductor 100 includes a base board 110, a first conducting element 120, a second conducting element 140 and at least one first lumped element 130. As shown in FIG. 1, the first conducting element 120 is disposed on the base board 110, and the base board 110 is disposed on the second conducting element 140. In an embodiment, the base board 110 is a PCB board, the first conducting element 120 is formed at a first side of the base board 110, and the second conducting element 140 is formed at a second side of the base board 110, which is not limited herein.

As shown in FIG. 1, in the embodiment, the first conducting element 120 is metal and includes an opening OW. The first lumped element 130 is disposed across the opening OW. In such a way, when the artificial magnetic conductor 100 is assembled to the electronic devices 200*a*, 200*b*, 200*c* or 200*d*, a current having a same phase as the current in the antenna is generated. Therefore, the radiation efficiency of the antenna is good. In addition, no interconnecting structure between the artificial magnetic conductor 100 and the electronic device is needed, which helps to reduce the integral thickness of the electronic device 200*a*, 200*b*, 200*c* or 200*d*.

As shown in FIG. 1, in the embodiment, the first lumped element 130 is disposed on the corresponding first conducting element 120, and the first lumped element 130 is disposed across the opening OW. In an embodiment, the first lumped element 130 is, but not limited to, an inductor, a capacitor or a resistor lumped element. In the embodiment, a current in the first lumped element 130 flows through the opening OW of the first conducting element 120 to generate a new current path, and thus the electronic device 200*a*, 200*b*, 200*c* or 200*d* could be thinner.

Details for assembling the artificial magnetic conductor 100 to the electronic device 200*a*, 200*b*, 200*c* or 200*d* are described below with respect to FIG. 2A to FIG. 2D.

Figures FIG. 2A to 2D are schematic diagrams showing electronic devices in different embodiments including the artificial magnetic conductor in FIG. 1. As shown in Figures FIG. 2A to FIG. 2D, in the embodiment, the electronic device 200*a*, 200*b*, 200*c* or 200*d* includes a front surface SF and a back surface SB opposite to each other, a back cover 210, an antenna 220 and the artificial magnetic conductor 100. The back cover 210 is disposed at the back surface SB. The antenna 220 is disposed at the front surface SF. The artificial magnetic conductor 100 is disposed between the back cover 210 and the antenna 220. The base board 110 of the artificial magnetic conductor 100 includes a first side 111 and a second side 112 opposite to each other. The first side 111 faces to the antenna 220, the second side 112 faces to the back cover 210. In an embodiment, the first conducting element 120 is disposed at the first side 111 or the second side 112 of the base board 110. That is, in the embodiment, the first conducting element 120 faces to the back cover 210 or the antenna 220.

Figure 2A:
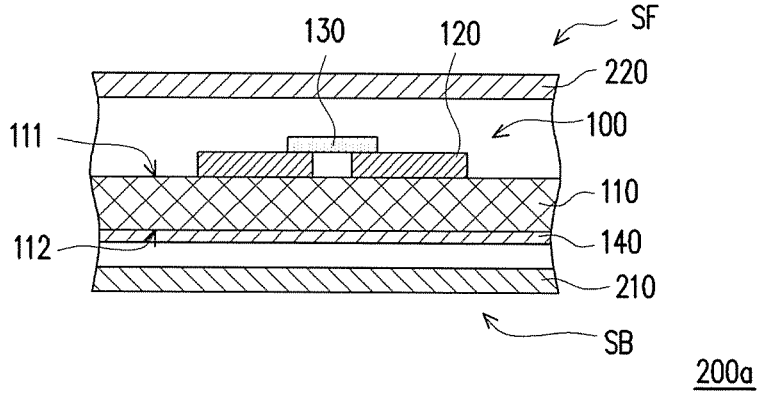
FIG. 2A to FIG. 2D are schematic diagrams showing electronic devices including the artificial magnetic conductor in FIG. 1 in different embodiments.

For example, as shown in FIG. 2A, in the embodiment, the base board 110 is located between the first conducting element 120 and the back cover 210. That is, the first conducting element 120 is disposed at the first side 111 of the base board 110, and the first conducting element 120 faces to the antenna 220. In the embodiment, the base board 110 and the back cover 210 have a distance (as shown in FIG. 2A) therebetween or not. As shown in FIG. 2A, when the base board 110 and the back cover 210 are spaced from a distance, the second conducting element 140 of the artificial magnetic conductor is located at the second side 112 of the base board 110 and facing to the back cover 210.

Figure 2B:
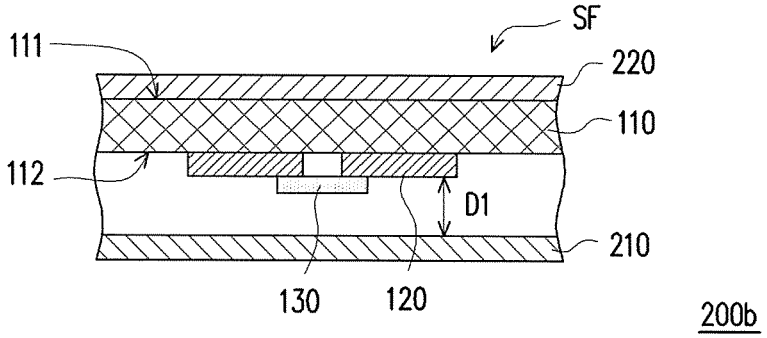
Figure 2C:
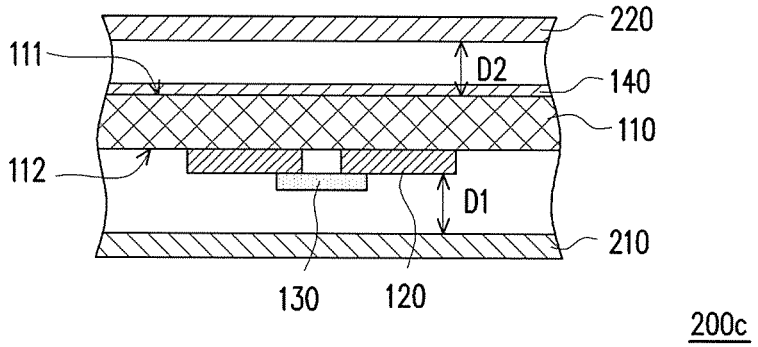

In the embodiments of FIG. 2B and FIG. 2C, the base board 110 is located between the first conducting element 120 and the antenna 220. The first conducting element 120 is located at the second side 112 of the base board 110 and facing to the back cover 210. In the embodiments of FIG. 2B and FIG. 2C, the first conducting element 120 and the back cover 210 have a distance D1 therebetween to avoid a short circuit.

In the embodiment of FIG. 2B, the base board 110 and the antenna 220 have no distance therebetween. For example, the electronic device 200*b* uses a PCB board including two metal layers disposed on opposite surfaces as the base board 110. One metal layer serves as the first conducting element 120 of the artificial magnetic conductor 100, and the antenna 220 is formed on another metal layer. In the embodiment of FIG. 2B, the second conducting element 140 is replaceable with the antenna 220. That is, the second conducting element 140 and the antenna 220 are formed integrally.

Alternatively, as shown in FIG. 2C, the base board 110 and the antenna 220 of the electronic device 200*c* have a distance D2 therebetween. The second conducting element 140 with the artificial magnetic conductor is located at the first side 111 of the base board 110 and facing to the antenna 220.

Figure 2D:
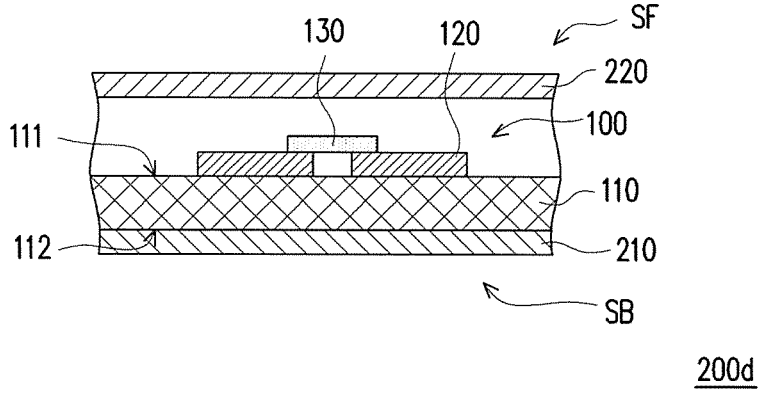

In the electronic device 200*d* in the embodiment of FIG. 2D, the base board 110 and the back cover 210 have no distance therebetween, the artificial magnetic conductor 100 is directly disposed on the back cover 210. In an embodiment, the base board 110 is a PCB board that includes two metal layers disposed on the opposite surfaces of the PCB board. One metal layer serves as the first conducting element 120 with the artificial magnetic conductor 100 and another metal layer serves as the back cover 210. That is, in an embodiment, the back cover 210 is foil led of metal, and the second conducting element 140 and the back cover 210 are formed integrally.

In such a way, the artificial magnetic conductor 100 that is assembled to the electronic device 200*a*, 200*b*, 200*c* or 200*d* generates a current in the same phase with the current in the antenna, and thus results a good radiation efficiency of the antenna. Moreover, no interconnecting structures are further needed between the artificial magnetic conductor 100 and the electronic device 200*a*, 200*b*, 200*c* and 200*d*, and thus the electronic device 200*a*, 200*b*, 200*c* or 200*d* can be thinner. Additionally, the volume of the electronic device 200*a*, 200*b*, 200*c* or 200*d* is reduced by the configuration of the first lumped element 130, and the electronic device can be thinner.

In the above embodiments, the base board 110 of the artificial magnetic conductor 100 is a PCB board. In another embodiment, the base board 110 is a flexible printed circuit (FPC). In an embodiment, the base board 110 is formed directly on the back cover 210 of the electronic device 200*a*, 200*b*, 200*c* or 200*d* via a laser direct structuring (LDS) technology to improve the efficiency of a 3D antenna.

In the embodiments, the number of the artificial magnetic conductor 100 is changed according to practical usages. The shape and the arrangements of the first conducting element 120 are also various according to requirements, which is not limited herein. Details in embodiments are described below with respect to FIG. 3 to FIG. 6.

Figure 3:
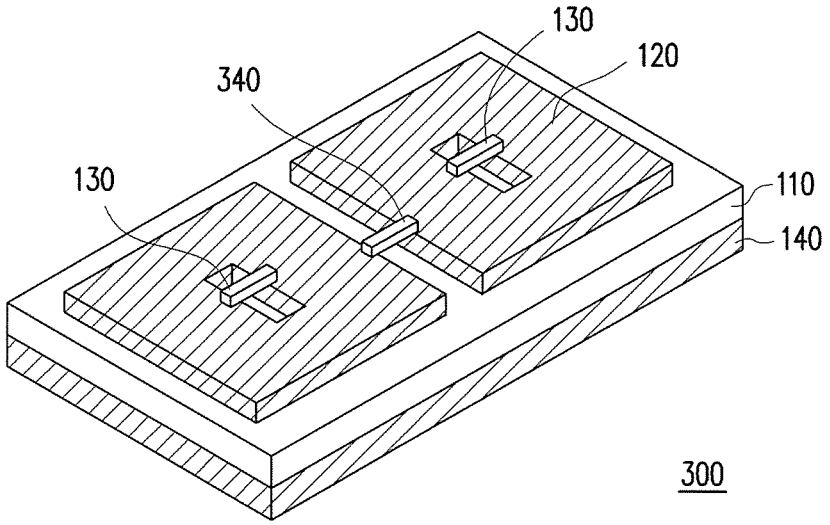
FIG. 3 is a schematic diagram showing an artificial magnetic conductor in an embodiment.

FIG. 3 is a schematic diagram showing an artificial magnetic conductor in an embodiment. Referring to FIG. 3, in the embodiment, an artificial magnetic conductor 300 is similar to the artificial magnetic conductor 100 in FIG. 1, the differences is described hereinafter In the embodiment, the artificial magnetic conductor 300 includes a plurality of the first conducting element 120, and the artificial magnetic conductor 300 further includes a second lumped element 340 connecting the two first conducting elements 120. In the embodiment, the artificial magnetic conductor 300 has the advantages similar to the artificial magnetic conductor 100, the description of which is omitted herein.

Figure 4:
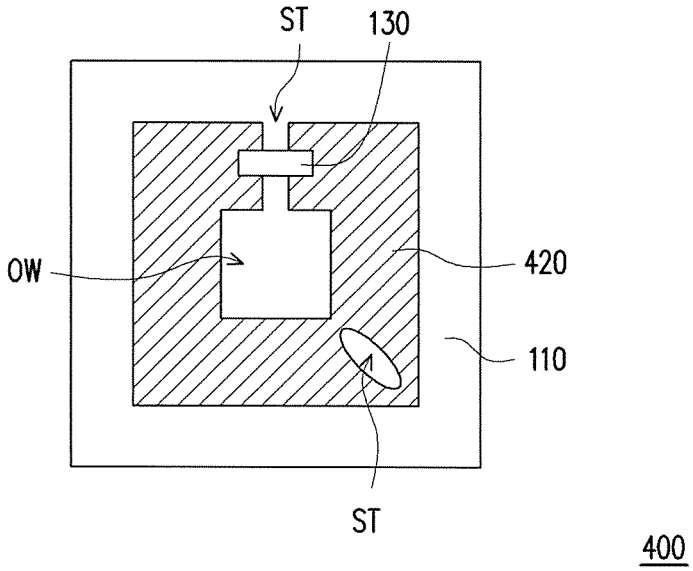
FIG. 4 is a schematic diagram showing an artificial magnetic conductor in an embodiment.

FIG. 4 is a schematic diagram showing an artificial magnetic conductor in an embodiment. Referring to FIG. 4, in the embodiment, an artificial magnetic conductor 400 is similar to the artificial magnetic conductor 100 in FIG. 1, the differences is described hereinafter. In the embodiment, a first conducting element 420 of the artificial magnetic conductor 400 includes a plurality of slots ST, and the first lumped element 130 is disposed across at least one of the slots ST. In the embodiment, the shapes and locations of the slots ST can be changed, which is not limited herein. As shown in FIG. 4, in the embodiment, the slots ST are elliptical or rectangular. In an embodiment, the slots ST are selectively connected with a boundary of the first conducting element 420. In an embodiment, the slots ST are not connected with the boundary of the first conducting element 420. As shown in FIG. 4, the opening OW of the artificial magnetic conductor 400 and the slots ST are interconnected.

In this way, when the artificial magnetic conductor 400 is assembled to the electronic device 200*a*, 200*b*, 200*c* or 200*d*, with the configuration of the first lumped element 130, the electronic device 200*a*, 200*b*, 200*c* or 200*d* can be thinner. Moreover, the artificial magnetic conductor 400 is similar to the artificial magnetic conductor 100, therefore the artificial magnetic conductor 400 has the advantages similar to the artificial magnetic conductor 100, the description of which is omitted herein.

Figure 5:
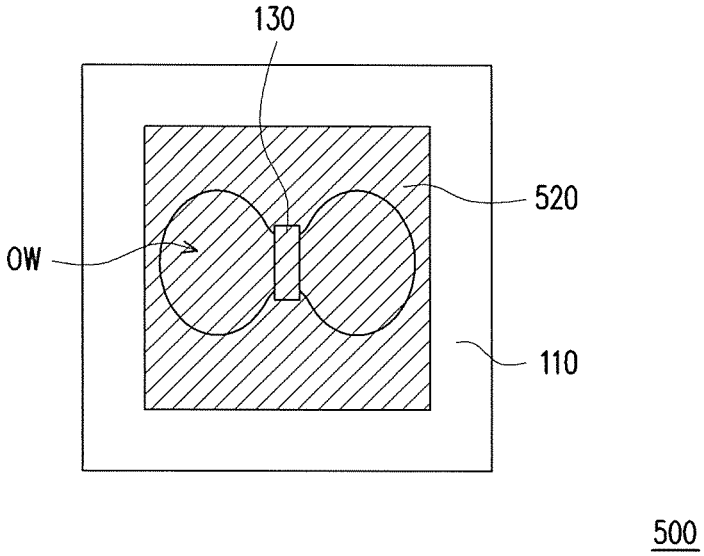
FIG. 5 is a schematic diagram showing an artificial magnetic conductor in an embodiment.

FIG. 5 is a schematic diagram showing an artificial magnetic conductor in an embodiment. Referring to FIG. 5, in the embodiment, an artificial magnetic conductor 500 is similar to the artificial magnetic conductor 100 in FIG. 1, the difference is that the opening OW of the first conducting element 520 is butterfly shaped. In other embodiments, the shapes of the opening OW of the first conducing element 520 are other shapes, which is not limited herein. That is, any element that include an opening OW while the first lumped element 130 is across the opening OW when the artificial magnetic conductor 500 is assembled to the electronic device 200*a*, 200*b*, 200*c* or 200*d*) can be used as the first conducting element 520 in the embodiment.

In addition, since the artificial magnetic conductor 500 is similar to the artificial magnetic conductor 100, the artificial magnetic conductor 500 has the advantages similar to the artificial magnetic conductor 100, the description of which is omitted herein.

Figure 6:
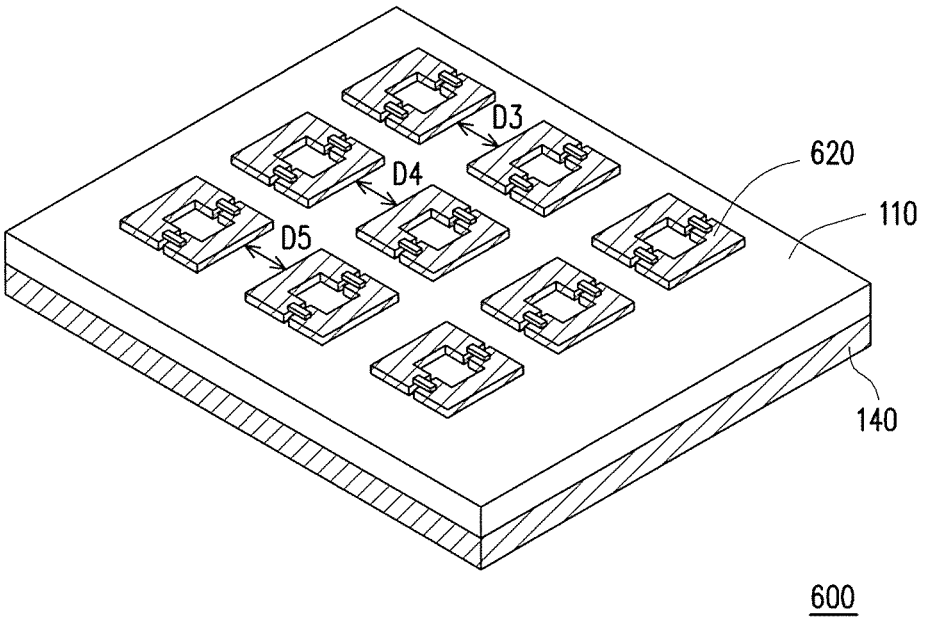
FIG. 6 is a schematic diagram showing an artificial magnetic conductor in an embodiment.

FIG. 6 is a schematic diagram showing an artificial magnetic conductor in an embodiment. Referring to FIG. 6, in the embodiment, an artificial magnetic conductor 600 is similar to the artificial magnetic conductor 100 in FIG. 1, the differences is described hereinafter. In the embodiment, the artificial magnetic conductor 600 includes a plurality of first conducting elements 620. The first conducting elements 620 are arranged in a two-dimensional array. As shown in FIG. 6, in the embodiment, the first conducting elements 620 have the same shape. However, in other embodiments, at least part of the conducting elements 620 have different shapes, such as the shape of the first conducting elements 120, 420 or 520 in FIG. 1, FIG. 3, FIG. 4 and FIG. 5.

As shown in FIG. 6, in the embodiment, intervals D3, D4 and D5 between the first conducting elements 620 are same. However, in other embodiments, the arrangements of intervals D3, D4 and D5 between the first conducting elements 620 are selectively different. In an embodiment, intervals (for example, interval D3 and interval D4) between part of the first conducting elements 620 are set irregularly, intervals (for example, interval D4 and interval D5) between part of the first conducting elements 620 are set regularly. That is, in the embodiment, part of the first conducting elements 620 are selected be arranged irregularly. When the first conducting elements 620 are assembled to the electronic devices 200*a*, 200*b*, 200*c* or 200*d*, a current having the same phase as the current in the antenna is generated, and thus results a good radiation efficiency of the antenna. Furthermore, since the artificial magnetic conductor 600 is a single layer structure that is connected to the electronic device without any interconnecting components, it helps to reduce the thickness of the electronic devices 200*a*, 200*b*, 200*c* or 200*d*.

In other embodiments, the shapes or arrangements of the first conducting elements 620 is various. Elements that include an opening OW (while the first lumped element 130 is across the opening OW when the artificial magnetic conductor 600 is assembled to the electronic device 200*a*, 200*b*, 200*c* or 200*d*) can serve as the first conducting elements 620 in the embodiments, and thus the electronic device 200*a*, 200*b*, 200*c* or 200*d* is thinner. In the embodiment, the artificial magnetic conductor 600 is similar to the artificial magnetic conductor 100, therefore the artificial magnetic conductor 600 has the advantages same to the artificial magnetic conductor 100, the description of which is omitted herein.

In the embodiments, the artificial magnetic conductor 300, 400, 500 and 600 are also adapted to be assembled to the electronic device 200*a*, 200*b*, 200*c* or 200*d*, respectively, to have similar advantages of the electronic device 200*a*, 200*b*, 200*c* or 200*d* above (which is omitted herein).

In sum, with the configuration of the first conducting element, the current having the same phase as the current in the antenna is generated, and thus results a good radiation efficiency of the antenna. Furthermore, since the artificial magnetic conductor is directly connected to the electronic device without any interconnecting component, it helps to reduce the thickness of the electronic device. Also, with the configuration of the first lumped element, the volume of the electronic device is reduced.

Although the invention includes been disclosed with reference to certain embodiments thereof, the disclosure is not for limiting the scope. Persons having ordinary skill in the art may make various modifications and changes without departing from the scope of the invention. Therefore, the scope of the appended claims should not be limited to the description of the embodiments described above.

What is claimed is:

1. An artificial magnetic conductor, comprising:

a base board;

a plurality of first conducting elements disposed at a first side of the base board and each of the first conducting elements including an opening completely encircled therein;

a second conducting element disposed at a second side of the base board;

a plurality of first lumped elements disposed on the corresponding first conducting elements respectively, wherein each of the first lumped elements is correspondingly disposed across the opening of the each of the first conducting elements and two ends of the each of the first lumped elements are connected to the each of the first conducting elements to form a current path consisting of one of the first lumped elements and one of the first conducting elements; and at least one second lumped element connected between two of the first conducting elements, wherein an open-ended interval is existed between the two of the first conducting elements, and the at least one second lumped element is disposed across the open-ended interval.

2. The artificial magnetic conductor according to claim 1, wherein the each of the first conducting elements further includes a plurality of slots, and the each of the first lumped elements is disposed across at least one of the slots.

3. An electronic device, comprising a front surface and a back surface opposite to each other, the electronic device comprising:

a back cover disposed at the back surface;

an antenna disposed at the front surface; and at least one artificial magnetic conductor located between the back cover and the antenna, wherein the artificial magnetic conductor includes:

a base board;

a plurality of first conducting elements disposed at a first side of the base board and each of the first conducting elements including at least one opening completely encircled therein;

a second conducting element disposed at a second side of the base board;

a plurality of first lumped elements disposed on the corresponding first conducting elements respectively, wherein each of the first lumped elements is correspondingly disposed across the opening of the each of the first conducting elements and two ends of the each of the first lumped elements are connected to the each of the first conducting elements to form a current path consisting of one of the first lumped elements and one of the first conducting elements; and at least one second lumped element connected between two of the first conducting elements, wherein an open-ended interval is existed between the two of the first conducting elements, and the at least one second lumped element is disposed across the open-ended interval.

4. The electronic device according to claim 3, wherein the base board is located between the plurality of first conducting elements and the back cover.

5. The electronic device according to claim 3, wherein the base board is located between the plurality of first conducting elements and the antenna.

6. The electronic device according to claim 3, wherein part of the artificial magnetic conductors are arranged irregularly.

7. The electronic device according to claim 3, wherein at least one of the first conducting elements further includes a plurality of slots, and the at least one of the first lumped elements is disposed across at least one of the slots.

8. The electronic device according to claim 3, wherein the second conducting element and the back cover are formed integrally.

9. The electronic device according to claim 3, wherein the second conducting element and the antenna are formed integrally.

10. An artificial magnetic conductor, comprising:

a base board;

a plurality of first conducting elements disposed at a first side of the base board and arranged in a two-dimensional array, each of the plurality of first conducting elements comprising an opening completely encircled therein and a plurality of slots;

a second conducting element disposed at a second side of the base board;

a plurality of first lumped elements, wherein each of the plurality of first lumped elements is disposed across at least one of the slots of the corresponding first conducting element and two ends of the each of the first lumped elements are connected to the corresponding first conductive element to form a current path consisting of one of the first lumped elements and the corresponding first conducting element, and at least one second lumped element connected between two of the first conducting elements, wherein an open-ended interval is existed between the two of the first conducting elements, and the at least one second lumped element is disposed across the open-ended interval.

* * * * *